United States Patent [19]

Igel et al.

[11] 4,430,850

[45] Feb. 14, 1984

[54] SPINDLE MOUNTING FOR RING SPINNING MACHINE

[75] Inventors: Wolfgang Igel, Ebersbach; Frieder Probst, Eislingen; Gerhard Haussmann, Ebersbach-Sulpach; Max Hartmannsgruber, Krichheim, all of Fed. Rep. of Germany

[73] Assignee: Zinser Textilmaschinen GmbH, Ebersbach, Fed. Rep. of Germany

[21] Appl. No.: 323,081

[22] Filed: Nov. 19, 1981

[30] Foreign Application Priority Data

Nov. 20, 1980 [DE] Fed. Rep. of Germany ..... 3043806

[51] Int. Cl.[3] ..... D01H 7/04

[52] U.S. Cl. ..... 57/130; 57/105

[58] Field of Search ..... 57/104, 105, 129, 130, 57/133, 134, 135

[56] References Cited

U.S. PATENT DOCUMENTS

| | | | |
|---|---|---|---|
| 1,983,038 | 12/1934 | Lenk | 57/105 |
| 2,304,370 | 12/1942 | Neal | 57/130 |
| 2,479,168 | 8/1949 | Keene et al. | 57/130 |
| 2,573,081 | 10/1951 | Winslow | 57/130 X |
| 3,479,809 | 11/1969 | Herubel | 57/105 |
| 3,664,111 | 5/1972 | Weber et al. | 57/105 |
| 3,765,161 | 10/1973 | Kohler | 57/105 X |
| 4,193,254 | 3/1980 | Fusaroli | 57/105 |

FOREIGN PATENT DOCUMENTS

| | | |
|---|---|---|
| 1785232 | 7/1971 | Fed. Rep. of Germany . |
| 2428851 | 1/1976 | Fed. Rep. of Germany . |

OTHER PUBLICATIONS

German Publication Melliand Textilberichte of Jun. 1970, pp. 644–646.

German Publication Melliand Textilberichte, Oct. 1974, pp. 828–831.

*Primary Examiner*—John Petrakes

*Attorney, Agent, or Firm*—Karl F. Ross

[57] ABSTRACT

A row of spindles carried on a common rail have whorls in tangential contact with a driving belt urged toward the spindle axes by pressure rollers offset therefrom, the whorls being of a diameter on the order of half the roller diameter. Each whorl is journaled on an upper end of an upright, stationary shaft supported by the rail through two vertically separated elastic retainers.

3 Claims, 2 Drawing Figures

SPINDLE MOUNTING FOR RING SPINNING MACHINE

FIELD OF THE INVENTION

Our present invention relates to a ring spinning machine with a row of vertical spindles carried on a common supporting rail and provided with respective whorls which are in substantially tangential contact with a driving belt stretched between the whorls and several pressure rollers offset from them in the direction of belt motion.

BACKGROUND OF THE INVENTION

In ring spinning machines of this type it has been the practice to make the diameters of the whorls and of the pressure rollers about equal to each other, usually of approximately 30 mm. In order to prevent the driving belt from exerting a tilting moment upon the spindles, the whorls may be directly journaled by so-called neck bearings on the upper ends of respective upright shafts fixedly mounted on the supporting rail.

OBJECTS OF THE INVENTION

An object of our present invention is to provide means for reducing the noise generated by the operation of such a spindle array.

Another object is to reduce the amount of energy consumed in driving the spindles.

SUMMARY OF THE INVENTION

We have found, in accordance with our present invention, that these objects can be attained by significantly reducing the diameter of the whorls with reference to that of the pressure rollers and, at the same time, elastically mounting the spindle-bearing shafts on the supporting rail. Especially with whorl diameters less than 30 mm and roller diameters on the order to twice the whorl diameters, these improvements are quite noticeable. The reduction in whorl diameter allows a given spindle speed to be attained with a slower-moving driving belt while the rotary speed of the less numerous pressure rollers is also significantly decreased; this alone entails a saving of electric power while diminishing the noise. The increase in the diameter of a pressure roller, lying midway between the points of engagement of the driving belt with two neighboring whorls, tends to straighten that belt with further lessening of the energy requirement. The elastic mounting of the bearing shafts on the supporting rail impedes the transmission of the unavoidable oscillations of these shafts to the rail, thereby preventing resonant vibrations of the latter with resulting further noise abatement.

Structural and economical considerations limit, of course, the extent to which the whorl diameter can be reduced and the roller diameter can be enlarged. A convenient value for the whorl diameter is approximately 24 mm, coupled with a roller diameter of about 50 mm.

BRIEF DESCRIPTION OF THE DRAWING

The above and other features of our invention will now be described in detail with reference to the accompanying drawing in which.

SPECIFIC DESCRIPTION

Figure 1:
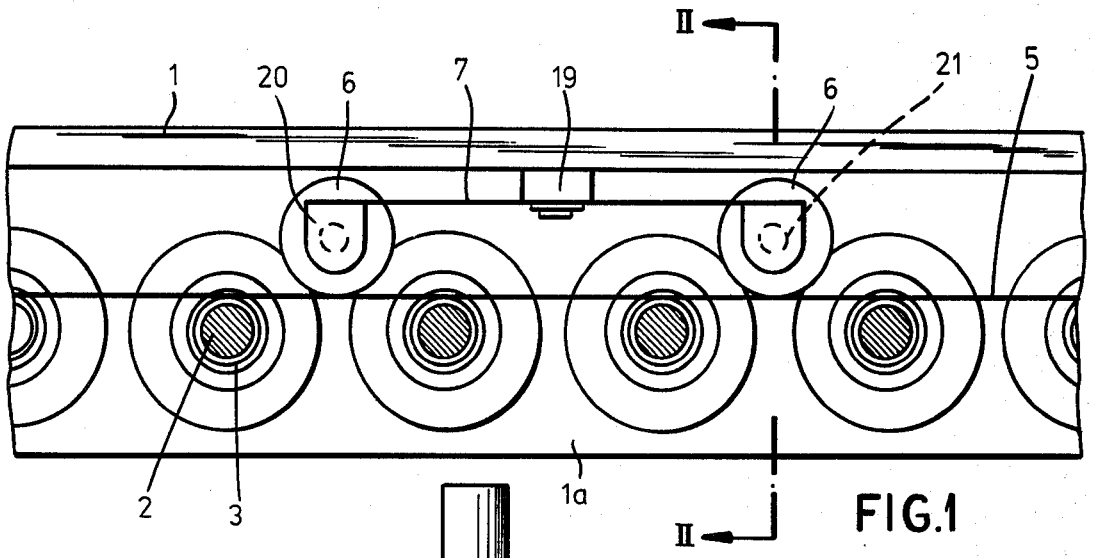
FIG. 1 is a fragmentary top view (partly in section) of an assembly of spindles and pressure rollers embodying our invention, mounted on a common supporting rail.
Figure 2:
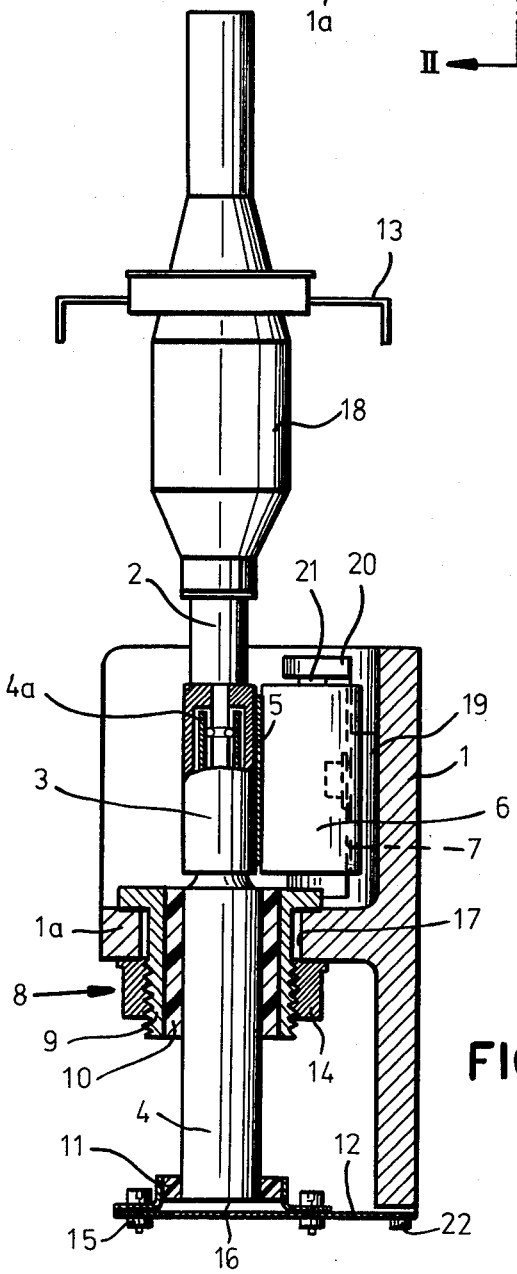
FIG. 2 is a part-sectional elevational view taken on the line II—II of FIG. 1.

In FIGS. 1 and 2 we have shown a spindle rail 1 with a horizontal flange 1*a* having equispaced apertures 17 each accommodating an externally threaded rigid sleeve 9 held in position by a nut 14. Sleeve 9 and nut 14 form part of a retainer 8 engaging, through a resilient bushing 10, an upright shaft 4 whose upper extremity 4*a* forms a bearing for a whorl 3 rigid with a spindle 2. The spindle carries a cop 18 and penetrates a vertically movable ring rail 13 serving for the building of yarn packages in the well-known manner.

The whorls 3 of all the spindles 2 mounted on rail 1 are tangentially engaged by a driving belt 5 which is being urged toward the spindle axes by pairs of pressure rollers 6 that are supported on rail 1 through the intermediary of respective leaf springs 7 and bosses 19. Each leaf spring 7 has bifurcate ends terminating in heads 20 at the top and at the bottom of an associated roller shaft 21. The rollers 6, it will be noted, have about twice the diameter of whorls 3.

In order to steady the bearing shaft 4 of each spindle 2 and align it precisely with the spindle axis, we provide the bottom end of that shaft with another retainer which is vertically spaced from retainer 8 and comprises a ring 16 engaging that shaft end through the intermediary of a resilient annular insert 11. Ring 16 is limitedly adjustable in a horizontal plane by being shiftably mounted with the aid of screws 15 on a carrier plate 12 rigid with rail 1, the screws 15 passing through suitably enlarged openings in the ring and the carrier plate. The connection between plate 12 and rail 1 is made by screws 22. The vertical distance between retainer 8 and whorl 3 should be as close as possible.

We claim:

1. In a ring spinning machine, in combination;

a rail provided with a horizontal flange having a row of spaced-apart apertures;

a plurality of rigid sleeves with vertical axes respectively mounted in said apertures;

a plurality of elastic bushings respectively inserted into said sleeves;

a plurality of upright shafts respectively supported in said bushings, each of said shafts having an upper extremity projecting above the respective bushing and further having a lower end projecting beyond said bushing below said flange;

a plurality of vertical spindles having lower extremities provided with respective whorls, said lower extremities being rotatably journaled on said upper extremities of respective shafts;

a pair of retaining rings independent of the respective sleeve fastened to said rail below said flange, said retaining rings elastically engaging said lower end through resilient, annular inserts at locations vertically spaced from each other and from the respective bushing;

a driving belt stretched above said flange in tangential contact with said whorls for jointly rotating said spindles; and a plurality of pressure rollers carried on said rail on a side of said driving belt opposite said whorls and offset from said whorls in the direction of belt motion, said whorls having diameters substantially less than 30 mm, said pressure rollers having diameters substantially greater than 30 mm.

2. The combination defined in claim 1 wherein the diameters of said pressure rollers are about twice the diameters of said whorls.

3. The combination defined in claim 2 wherein the diameters of said whorls and of said pressure rollers are approximately 24 mm and 50 mm, respectively.

* * * * *